US007510466B1

(12) United States Patent
Norman

(10) Patent No.: US 7,510,466 B1
(45) Date of Patent: Mar. 31, 2009

(54) SHAFT ADAPTER FOR GRINDING CUP

(75) Inventor: Murray Norman, North Bay (CA)

(73) Assignee: Pilot Diamond Tools Ltd., North Bay Ontario (CA)

( * ) Notice: Subject to any disclaimer, the term of this patent is extended or adjusted under 35 U.S.C. 154(b) by 0 days.

(21) Appl. No.: 12/004,763

(22) Filed: Dec. 21, 2007

(51) Int. Cl.
*B24B 55/02* (2006.01)

(52) U.S. Cl. ..... 451/450; 451/559; 451/911; 451/177; 451/415; 451/342

(58) Field of Classification Search ..... 451/449, 451/450, 548, 559, 911, 177, 259, 415, 359, 451/342
See application file for complete search history.

(56) References Cited

U.S. PATENT DOCUMENTS 2,666,307 A * 1/1954 Higert ..... 464/92
5,637,037 A * 6/1997 Bergquist ..... 451/450
5,727,994 A * 3/1998 Sjolander et al. ..... 451/359
6,056,628 A * 5/2000 Bergqvist et al. ..... 451/177
6,129,619 A * 10/2000 Bergqvist ..... 451/450
6,835,114 B2 12/2004 Sjolander
2004/0077298 A1* 4/2004 Sjolander ..... 451/342
2008/0207102 A1* 8/2008 Sjolander et al. ..... 451/548

* cited by examiner

*Primary Examiner*—Eileen Morgan
(74) *Attorney, Agent, or Firm*—Hudak, Shunk & Farine Co. LPA

(57) ABSTRACT

A shaft adapter for removably mounting to the output or drive shaft of a grinding machine is disclosed. The shaft adapter is a three-component device which includes a collar portion, a compressible drive sleeve and an extension member. The extension member has a free-end adapted to matingly engage with a particular grinding cup. When the shaft adapted is mounted on the drive shaft, the compressible drive sleeve is compressed and elastically deformed between the corresponding, engaging ends of the collar portion and extension member so as to create a secure driving force between the rotating drive shaft of the grinding machine and the shaft adapter so that they rotate together as a unit when the grinding machine is in use.

8 Claims, 5 Drawing Sheets

SHAFT ADAPTER FOR GRINDING CUP

FIELD OF THE INVENTION

The invention relates to an adapter for mounting to the shaft of a grinding machine and for holding a grinding cup.

BACKGROUND OF THE INVENTION

In a typical grinding machine, the rotor or output shaft of the machine and a suitable grinding cup are engaged and rotate together providing a means for sharpening and/or re-shaping drill bits. Over time, however, the connection between the output shaft and the grinding cup wears causing the grinding cup to become loose in its "seat" in the end of the shaft, making the grinding cup more likely to fall out. As well, the loose fitting connection between the grinding cup and the output shaft decreases the overall efficiency of the grinding machine. Replacing the entire rotor shaft, however, can be both costly and time consuming.

Various adapters or chucks are known for mounting a grinding cup to the shaft of a grinding machine. For instance, U.S. Pat. No. 6,835,114 to Sjolander discloses a holder device (see FIG. 14) for anchoring a grinding cup to an output shaft of a grinding machine. The body portion of the holder device has a centrally disposed cavity that is sized and shaped to permit the holder device to be detachably connected to the output drive shaft of the grinding machine. Retaining means are provided on either the output drive shaft or in the adapter (or a combination of both) to detachably retain the holder device so that it will not fly off the output shaft during use. The centrally disposed cavity has a drive section formed at the end thereof for drivably engaging the end of the output shaft. The drive section preferably has a hexagonal cross-section which is specifically adapted to engage with a specific output shaft of a grinding machine having a hexagonally-shaped end. Accordingly, the holder device is not easily adaptable to drivingly engage various forms of output shafts.

SUMMARY OF THE INVENTION

According to one aspect of the invention, there is provided a shaft adapter for detachably mounting a grinding cup to the drive shaft of a grinding machine. The shaft adapter comprises a collar portion slidably mountable on the drive shaft of the grinding machine, the collar portion having a passageway extending therethrough, the passageway having internal threads and a first end provided with an end surface and an open, second end. A compressible drive sleeve member is adapted to be received in the passageway of the collar portion, one end of the compressible drive sleeve member abutting the end surface of the collar portion, the compressible drive sleeve having a length less than the length of the passageway of the collar portion. The shaft adapter also includes an extension member having a first end adapted to receive the free-end of the drive shaft and a second end for detachably receiving the grinding cup, the first end having a threaded outer surface for engaging with the second end of the collar portion, wherein the engagement between the collar portion and the extension member compresses and elastically deforms the compressible drive sleeve between the end surface of the collar portion and the first end of the extension member thereby creating a driving force between the drive shaft and the shaft adapter when the grinding machine is in use.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENT

Figure 1:
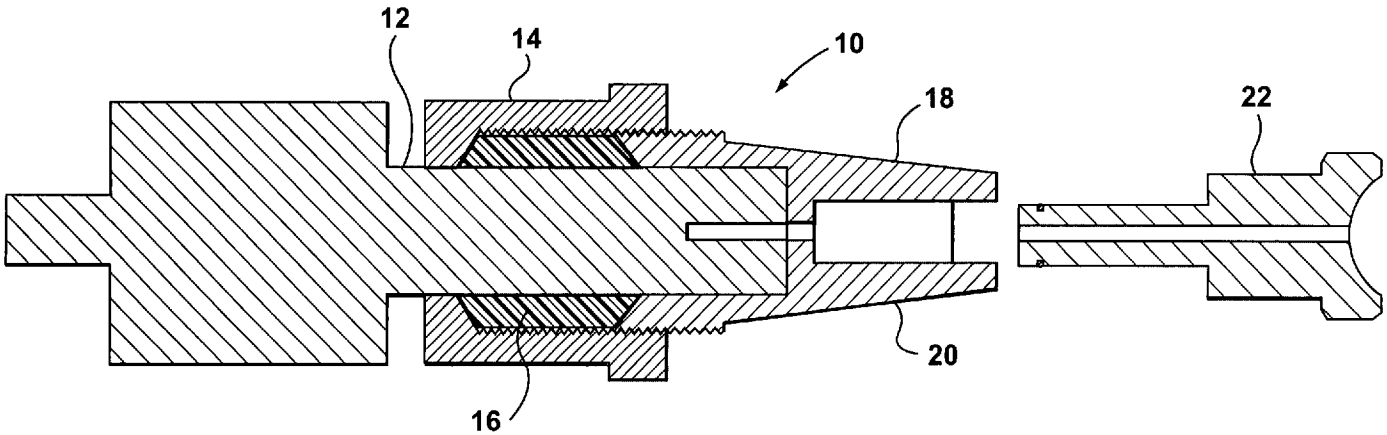
FIG. 1 is a cross-sectional view of a shaft adapter and associated grinding cup according to one embodiment of the invention wherein the shaft adapter is mounted on the drive shaft of a grinding machine.
Figure 1A:
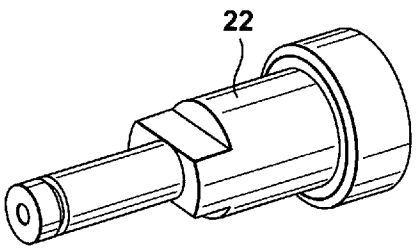
FIG. 1A is a perspective view of the grinding cup shown in FIG. 1.

Referring first to FIG. 1, there is shown a cross-sectional view of a shaft adapter 10 according to one embodiment of the invention, the shaft adapter 10 being mounted on the original or existing output or drive shaft 12 of a grinding machine (not shown). The shaft adapter 10 comprises a compression housing or collar portion 14, a compressible drive sleeve 16, and an extension member 18. In order to mount the shaft adapter 10 on the drive shaft 12 of the grinding machine, the collar portion 14 is first positioned on the drive shaft 12. The collar portion 14 is free-sliding on the drive shaft; therefore, can be positioned rearward on the shaft 12. The compressible drive sleeve 16 is then placed on the drive shaft 12 to the desired location on the shaft 12. The compressible drive sleeve 16 is intended to have at least a friction fit on the drive shaft 12. Therefore, the compressible drive sleeve 16 is typically made of a rubber or plastic type of material and is sized to fit a standard output or drive shaft 12 of a grinding machine. Once the compressible drive sleeve 16 is in position on the drive shaft 12, the collar portion 14 is then slid forward so as to engage the compressible drive sleeve 16. The extension member 18 of the shaft adapter 10 is then positioned on the free-end of the drive shaft 12 and engages the compressible drive sleeve 16 and mates with the collar portion 14. The extension member 18 mates with the collar portion 14 by means of their interlocking ends, which typically comprise corresponding threaded ends. As the extension member 18 and the collar portion 14 are screwed together, the compressible drive sleeve 16 is further compressed around the outer surface of the drive shaft 12 which creates a secure drive connection between the shaft adapter 10 and the drive shaft 12, thereby ensuring that the shaft adapter 10 rotates together with the drive shaft 12 when the grinding machine is in use. The free-end 20 of the extension member 18 extends beyond the original free-end of the drive shaft 12 and is adapted to receive a corresponding grinding cup 22 (see also FIG. 1). Therefore, with all of the components of the shaft adapter 10 in place on the drive shaft 12 with the corresponding grinding cup 22 seated in the free-end 20 of the extension member, the grinding machine is rendered fully operational. The individual components of the shaft adapter 10 will now be described in further detail below.

Figure 2:
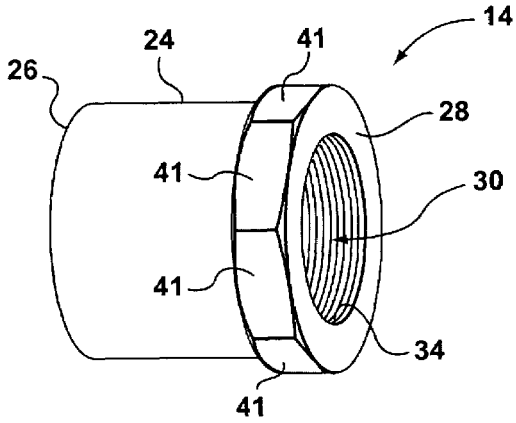
FIG. 2 is a perspective side view of a collar portion of the shaft adapter shown in FIG. 1.
Figure 3:
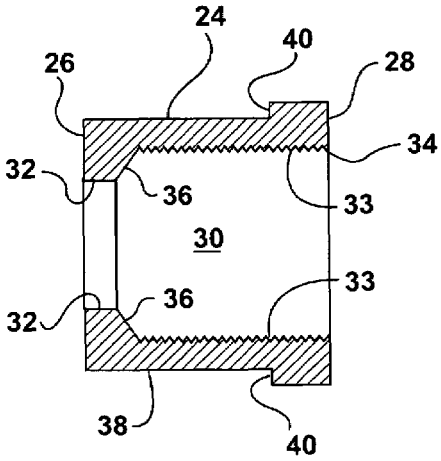
FIG. 3 is a cross-sectional view of the collar portion shown in FIG. 2.

As shown in FIGS. 2 and 3, the collar portion 14 comprises a generally cylindrical body member 24 having a first end 26 and a second end 28. An opening or passageway 30 extends through the cylindrical body member 24 from a first opening 32 in the first end 26 of the cylindrical body 24 to a second opening 34 in the second end 28 of the cylindrical body 24. The first opening 32 is sized to receive the drive shaft 12 of the grinding machine and, in the subject embodiment, is smaller than the second opening 34. Since the first opening 32 is smaller than the second opening 34, the first end 26 has a lip or end surface 36 on the inside edge thereof. The end surface 36 provides a stop or a surface against which the compressible drive sleeve 16 abuts when the shaft adapter 10 is assembled as will be described in further detail below.

The inner passageway 30 of the cylindrical body member 24 is provided with internal threads 33 so as to provide a means for engaging with the extension member 18 of the shaft adapter 10. As well, the inner passageway 30 is sized so as to receive the compressible drive sleeve 16 when the shaft adapter 10 is assembled. Accordingly, the compressible drive sleeve 16 can be inserted into the passageway 30 through second opening 34 until it abuts the lip or end surface 36 of the first end 26 of the cylindrical body 24.

Figure 4:
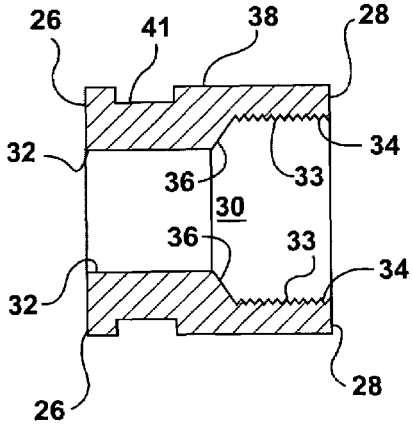
FIG. 4 is a cross-sectional view of an alternate embodiment of the collar portion of the shaft adapter.

The outer surface 38 of the cylindrical body member 24 can be a uniform surface or may be formed with a raised portion 40 at one end thereof that is shaped with flat portions (i.e. "wrench flats") 41 which act as gripping surfaces for tools, such as a wrench, to be used to assist in screwing together the collar portion 14 and the extension member 18 when the shaft adapter 10 is assembled. While the subject embodiment shows the raised portion 40 as being located proximal the second end 28 of the cylindrical body member 24, it will be understood that the raised portion 40 with the flats or gripping surfaces could be located at any point along the outer surface 38 of the cylindrical body member 24. As well, rather than having the flats or gripping surfaces formed on a raised portion 40, they could instead be formed in a recessed portion 43 on the outer surface 38 of the cylindrical body, as shown in FIG. 4.

Figure 5:
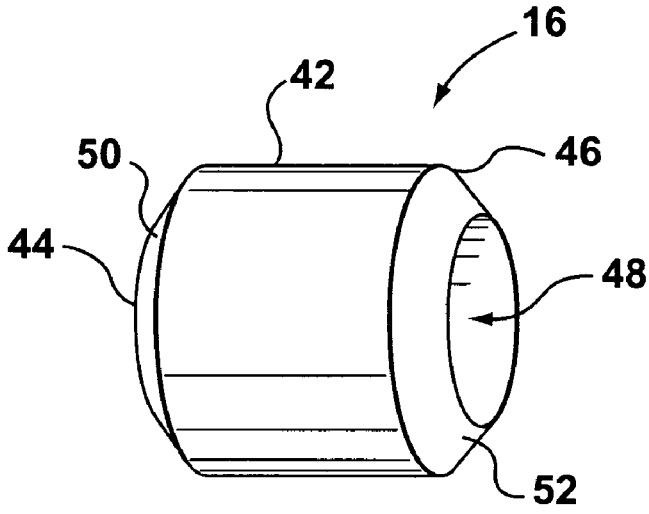
FIG. 5 is a perspective side view of a compressible drive sleeve of the shaft adapter as shown in FIG. 1.
Figure 6:
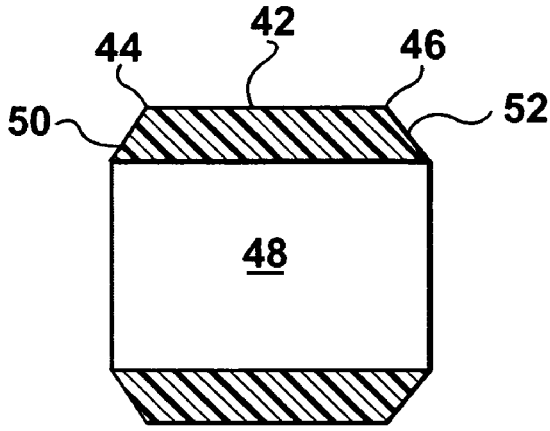
FIG. 6 is a cross-sectional view of the compressible drive sleeve shown in FIG. 5.

Referring now to FIGS. 5 and 6, there is shown a detail view of the compressible drive sleeve 16. As shown, the compressible drive sleeve is comprised of a generally cylindrical or tubular member 42 made of any suitable resilient rubber or plastic material (i.e. an elastomeric material) that will deform when subjected to a compressive force and will return to its original shape when the compressive force is removed. The tubular member 42 has opposed ends 44, 46 and an opening or passageway 48 extending therethrough. The opening or passageway 48 is sized so that it creates an interference or friction fit with the shaft 12 of the grinding machine when it is positioned thereon. In the embodiment shown, the outer edges 50, 52 of respective ends 44, 46 of the tubular member 42 are angled or tapered so as to correspond to the shape of the lip or end surface 36 at the first end 26 of the collar portion 14. However, it will be understood that the outer edges 50, 52 could instead be formed as generally flat, vertical surfaces or slightly rounded surfaces, for example.

The outer diameter of the compressible drive sleeve 16 is sized so as to be received in the passageway 30 formed in the collar portion 14. The length of the compressible drive sleeve 16 is such that a sufficient portion of the inner threaded surface of the passageway 30 is left exposed to ensure secure engagement with the extension member 18 when the shaft adapter 10 is assembled.

While the subject embodiment has been described as employing a compressible drive sleeve member 16 comprised of a generally tubular member 42, it is also contemplated that the compressible drive sleeve 16 could instead be comprised of a series of O-ring members that are stacked adjacent to each other to create the sleeve 16.

Figure 7:
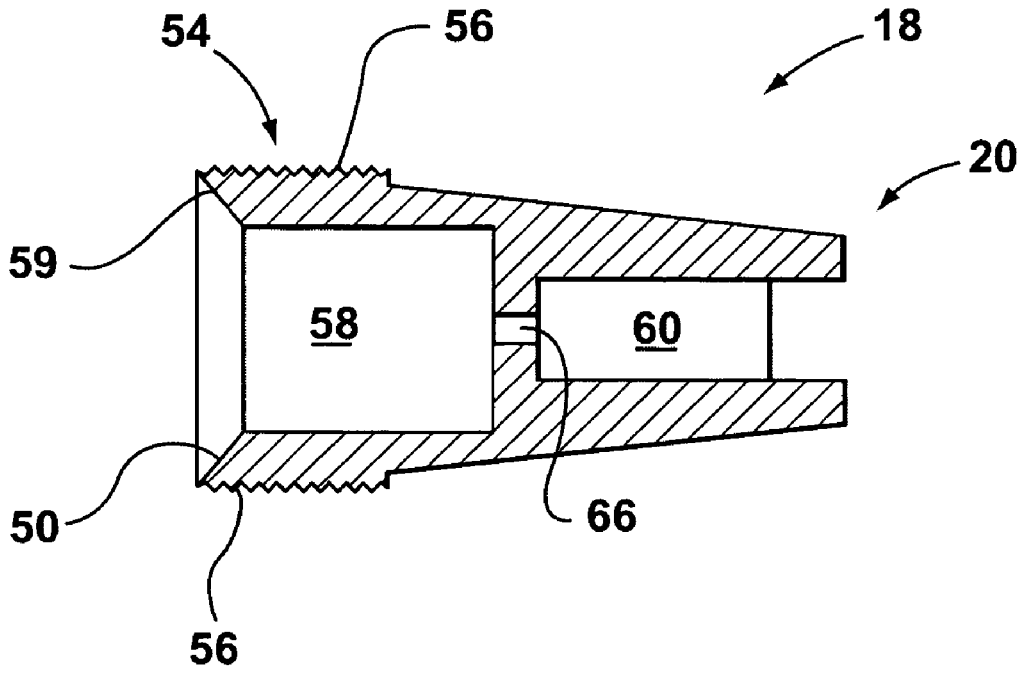
FIG. 7 is a cross-sectional view of an elongate member of the shaft adapter as shown in FIG. 1.

Referring now to FIG. 7, there is shown a detail cross-sectional view of the extension member 18 of the shaft adapter 10. The extension member 18 has a first end 54 adapted to engage the second end 28 of the collar portion 14. The second or free-end 20 of the extension member 18, as described above, is adapted to receive a corresponding grinding cup 22 and extends beyond the original free-end of the drive shaft 12.

The first end 54 of the extension member 18 has a threaded outer surface 56 intended to engage and mate with the internal threads 33 provided on the inside surface of passageway 30 of the collar portion 14. A first opening or passageway 58 is formed in the first end 54 of the extension member 18 which is sized so that the extension member 18 can fit on to the end of the rotor shaft 12 and mate with the collar portion 14 that is already positioned thereon. In the subject embodiment, the end edge 59 of the first end 54 of the extension member 18 is shaped so as to correspond to the angled or tapered surfaces of the outer edges 50, 52 of the compressible drive sleeve 16. By shaping the end edge 59 of the extension member 18 to correspond to the shape of the outer edge 52 of the compressible drive sleeve 16, good surface contact is achieved between the components as the extension member 18 is screwed onto the second end 24 of the collar portion 14, which helps to ensure that the compressible drive sleeve 16 is sufficiently compressed and deformed so as to seal tightly against the shaft 12 of the grinding machine creating the appropriate driving force between the rotating drive shaft 12 and the components of the shaft adapter 10.

Figure 8:
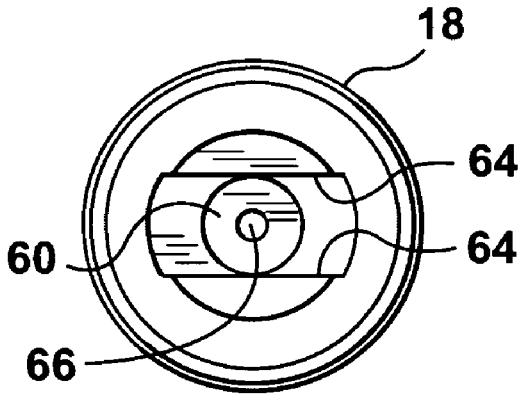
FIG. 8 is a right end view of the elongate member shown in FIG. 7.

In the embodiment shown, the free-end 20 of the extension member also has a second opening or passageway 60 extending therethrough. The opening or passageway 60 is adapted to receive a stem 62 of the corresponding grinding cup 22 (see FIG. 1). A transverse groove 64 (see FIG. 8) may also be formed in the free-end 20 of the extension member 18 for receiving the corresponding end of the grinding cup 22 so as to ensure a secure connection between the shaft adapter 10 and grinding cup 22 is achieved. However, it will be understood that the free-end 20 of the extension member 18 of the shaft adapter 10 may be adapted so as to correspond to a number of different grinding cups.

Furthermore, the first opening or passageway 58 and the second opening or passageway 60 of the extension member 18 are connected by means of a through-channel 66. The through-channel 66 permits cooling air or any other suitable coolant and/or lubricant to be fed through the shaft 12 of the grinding machine and through the shaft adapter 10 to cool the grinding portion of the grinding cup 22 when in use.

Figure 9:
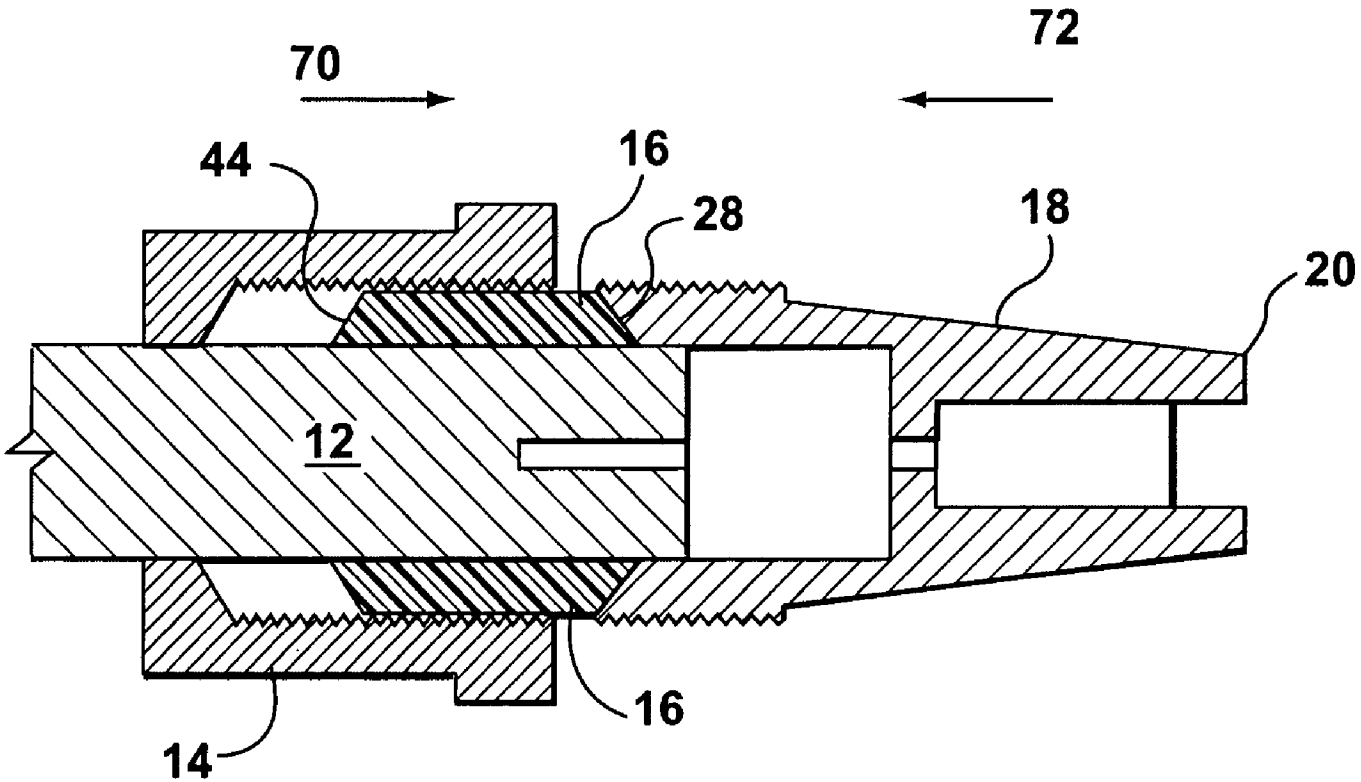
FIG. 9 is an exploded, cross-sectional view of the components of the shaft adapter being mounted on the drive shaft of the grinding machine.

The assembly of the shaft adapter 10 will now be described in further detail in reference to FIG. 9. As shown in the drawings, once the original drive shaft 12 of a grinding machine has worn out and is no longer able to achieve a secure fit or connection with the corresponding grinding cup, rather than replacing the entire shaft component of the grinding machine, the shaft adapter 10 of the present invention can be used to render the grinding machine operational. Firstly, the collar portion 14 is slid onto the original shaft 12 of the grinding machine. The compressible drive sleeve 16 is then positioned on to the drive shaft 12 more proximal to the free-end thereof. The collar portion 14 is then slid forward as indicated by arrow 70 until it engages the first end 44 of the compressible drive sleeve 16. The user may then select one of a variety of extension members 18, each of which has a free-end 20 adapted to correspond to a particular grinding cup, for example. The selected extension member 18 is then positioned on to the end of the drive shaft 12 and is pushed rearward onto the drive shaft, as indicated by arrow 72 until it reaches the collar portion 14 and is screwed into open, second end 28 thereof. As the extension member 18 is screwed into the collar portion 14, the compressible drive sleeve 16 is compressed against the lip or end surface 36 of the collar portion 14 as the threaded first end 54 of the extension member 18 advances in the opening or passageway 30 of the collar portion 14. The compression of the compressible drive sleeve 16 causes the drive sleeve 16 to deform in such a manner that it contracts in the longitudinal direction and expands in the transverse direction. The expansion of the compressible drive sleeve 16 in the transverse direction increases the friction force or interference fit against the drive shaft 12 which serves to further secure the shaft adapter 10 to the drive shaft 12 thereby ensuring that they rotate together as a unit. Accordingly, the three-part construction of the shaft adapter 10 creates a versatile means by which to render the drive shaft 12 of a grinding machine operable for use with a variety of grinding cups (depending on the specific structure of the free-end 20 of the extension member 18) with minimal tooling and time requirements.

While the present invention has been described with reference to certain preferred embodiments, it will be understood by persons skilled in the art that the invention is not limited to these precise embodiments and that variations or modifications can be made without departing from the scope of the invention as described herein.

I claim:

1. A shaft adapter for detachably mounting a grinding cup to the drive shaft of a grinding machine, said shaft adapter comprising:

a collar portion slidably mountable on said drive shaft of said grinding machine, said collar portion having a passageway extending therethrough, said passageway having internal threads and a first end provided with an end surface and an open second end;

a compressible drive sleeve member adapted to be received in said passageway of said collar portion, one end of said compressible drive sleeve member abutting said end surface of said first end of said collar portion, said compressible drive sleeve having a length less than the length of said passageway of said collar portion; and an extension member having a first end adapted to receive the free-end of the drive shaft and a second end for detachably receiving said grinding cup, said first end being received in said second end of said collar portion and having a threaded outer surface for engaging with the internal threads of said collar portion passageway;

wherein the engagement between said collar portion and said extension member elastically deforms said compressible drive sleeve between said end surface of said collar portion and said first end of said extension member thereby creating a driving force between said drive shaft and said shaft adapted when said grinding machine is in use.

2. A shaft adapter as claimed in claim 1, wherein said compressible drive sleeve is a tubular member made from an elastomeric material.

3. A shaft adapter as claimed in claim 1, wherein said compressible drive sleeve is comprised of a plurality of O-rings stacked adjacent to each other.

4. A shaft adapter as claimed in claim 1, wherein said collar portion has an outer surface, said outer surface being formed with flat portions around the circumference thereof for providing gripping surfaces for receiving grips of tools.

5. A shaft adapter as claimed in claim 4, wherein said flat portions are formed on a raised portion extending around the periphery of the collar portion.

6. A shaft adapter as claimed in claim 4, wherein a recessed groove is formed in the outer surface of said collar portion around the circumference thereof, said flat portions being formed in said recessed groove.

7. A shaft adapter as claimed in claim 1, wherein the second end of said extension member has an opening formed therein for receiving a stem of a grinding cup, said second end further including a transverse groove for receiving a corresponding protrusion on said grinding cup thereby creating a shoulder drive between said extension member and said grinding cup.

8. A shaft adapter as claimed in claim 1, wherein said first and second ends of said extension member are interconnected by means of a through-channel, said through-channel providing fluid access to a grinding portion of said grinding cup for the flow of a cooling fluid therethrough.

* * * * *